United States Patent [19]

Childs, Jr. et al.

[11] 3,933,542

[45] Jan. 20, 1976

[54] ROCKET PROPELLANT WITH ACRYLATE BINDER AND DIFLUOROAMINO PLASTICIZER

[75] Inventors: Lewis B. Childs, Jr., Vienna; James D. Martin, Alexandria, both of Va.

[73] Assignee: The United States of America as represented by the Secretary of the Navy, Washington, D.C.

[22] Filed: June 16, 1972

[21] Appl. No.: 263,892

[52] U.S. Cl. ..... 149/19.3; 149/19.91; 149/20

[51] Int. Cl.[2] ..... C06D 5/06

[58] Field of Search ..... 149/19, 20, 19.3, 19.91

[56] References Cited

UNITED STATES PATENTS

| | | | |
|---|---|---|---|
| 3,663,323 | 5/1972 | Engel et al. | 149/19 |
| 3,666,576 | 5/1972 | Engel | 149/19 |
| 3,813,305 | 5/1974 | Baldwin et al. | 149/19.91 X |

*Primary Examiner*—Edward A. Miller

[57] ABSTRACT

High energy, low radar attenuation propellant comprising (1) 25–55 weight percent of a binder which itself comprises from 2–25 weight percent of a copolymer of acrylic acid and a lower alkyl acrylate and 75–98 weight percent of an energetic difluoroamino group containing plasticizer, (2) 0–15 weight percent aluminum or boron (3) 45–75 weight percent of an oxidizer and (4) ½–5 weight percent curing agent.

14 Claims, No Drawings

ROCKET PROPELLANT WITH ACRYLATE BINDER AND DIFLUOROAMINO PLASTICIZER

BACKGROUND OF THE INVENTION

This invention generally relates to rocket propellants and more particularly to rocket propellants which have reduced combustion instability and low radar attenuation.

One of the vital requirements of most missile guidance systems is the maintenance of maximum radar communication between a central station and the guidance central mechanism of the inflight rocket. However, as is well known in the propellant art, effective communication is often quite severely distorted and even totally disrupted due to attenuation or interference originating from the combusting rocket propellant. In an attempt to overcome this problem new propellants have been developed but many of these propellants suffer from high frequency combustion instability. This research has been conducted to find propellant compositions which have negligible radar attenuation and which do not have high frequency combustion instability.

SUMMARY OF THE INVENTION

Accordingly, one object of this invention is to provide a rocket propellant.

Another object of this invention is to provide a rocket propellant which has negligible radar attenuation.

Yet another object of this invention is to provide a low radar attenuation rocket propellant which does not demonstrate high frequency combustion instability.

These and other objects of this invention are accomplished by providing a propellant which comprises (1) 25–55 weight percent of a binder which comprises (a) 2–25 weight percent of a copolymer which comprises about one to about 20 weight percent acrylic acid with the remainder comprising a lower alkyl acrylate and (b) 75–98 weight percent of an energetic difluoroamine group containing plasticizer, (2) 0–15 weight percent of a fuel which is either aluminum, boron or mixtures thereof, (3) 45–75 weight percent of an oxidizer, and (4) 1/2–5 weight percent curing agent, provided that the amount of oxidizer is sufficient to provide for complete oxidation of the binder and the fuel.

DESCRIPTION OF THE PREFERRED EMBODIMENT

The propellant composition of this invention as hereinbefore stated comprises four major constituents. The binder system of this propellant constitutes 25 to 55 weight percent of the propellant composition. This binder is itself composed of two different constituents. Thus 5 to 25 weight percent of the binder comprises a copolymer of acrylic acid and a lower alkyl acrylate. The term lower alkyl is intended to include alkyl groups of 1 to 6 carbon atoms. The ratio of the acrylic acid to the lower alkyl acrylates in this copolymer should be no more than about 1:4 so that the acrylic acid will constitute about one to about 20 weight percent, and preferably 6–8 weight percent, of this copolymer with the remainder being lower alkyl acrylate. Among the preferred lower alkyl acrylates are ethyl acrylate, methyl acrylate and butyl acrylate. The copolymer which is added to the other constituents of the instant propellant composition preferably has an intrinsic viscosity of about 0.4 – 0.8 dl/g as about a 0.5 grams/deciliter solution in ethyl acetate at about 25°C although polymers with an intrinsic viscosity of 0.2 – 1.1 dl/g can also be used.

The second part of the binder constituent is an energetic difluoroamine group containing plasticizer. This constitutes 75–98 weight percent of the binder component of the propellant. The preferred energetic difluoroamine group containing plasticizers are 1,2,3-tris[$\alpha,\beta$- bis (difluoroamino) ethoxy] propane (TVOPA), hexakis (difluoroamino) propylether, 1,2-di[2,2,3-tris (difluoroamino) propoxy]-1,2-bis (difluoroamino) ethane, 1,2,4,5-tetrakis (difluoroamino) amyl methacrylate, and mixtures thereof with TVOPA being the most preferred.

The second major constituent is selected from the group consisting of aluminum, boron and mixtures thereof. This constituent comprises 0–15 weight percent of the propellant. It has been found that when no aluminum or boron is in the propellant combustion instability is low but said instability is lowered by the presence of aluminum, boron or mixtures thereof. Thus preferably this rocket propellant contains 1–15 weight percent of aluminum, boron and mixtures thereof with aluminum being preferred because it reduces combustion instability better than boron.

The third major constituent of the propellant is an oxidizer which constitutes 45–75 weight percent of the composition. It should be noted that the amount of oxidizer present must be sufficient to provide for complete oxidation of the binder and the fuel component. While any of the standard oxidizers can be used it is preferred to use ammonium perchlorate, nitronium perchlorate, hydroxylammonium perchlorate and its derivatives, potassium perchlorate, ammonium nitrate and potassium nitrate with ammonium perchlorate being the most preferred oxidizer.

Additionally, the fourth major constituent of the present composition is a cross-linking agent which constitutes ½–5 weight percent of the propellant and which will aid the curing of the composition. Among the preferred cross-linking agents operable herein are any of the di or tri functional epoxides and isocyanates or any other materials which are conventionally employed as cross-linking agents for curing propellants such as those instantly disclosed. More specifically, Unox 221, a difunctional cycloaliphatic epoxide product of the Union Carbide Corp.

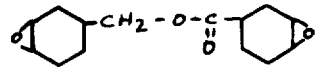

Araldite 178, a product of the Ciba Corp.

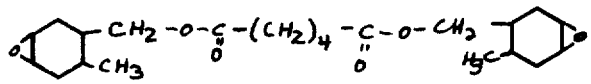

any of the bisphenol A-epichlorohydrin epoxides, tolylene diisocyanate, hexamethyline diisocyanate and the like.

Additionally other additives normally incorporated into composite propellants may be added herein, such as any of the various accelerators, burning rate modifiers, extenders, reinforcing agent, fillers and stabilizers.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLES 1–7

Some typical formulations which have been prepared are as follows:

| Weight %[b] | 1 | 2 | 3 | 4 | 5 | 6 | 7 |
|---|---|---|---|---|---|---|---|
| Binder[a] | 32.5 | 32.5 | 33.5 | 32.5 | 32.5 | 33.5 | 34.5 |
| Ammonium Perchlorate | 60.5 | 64.5 | 65.5 | 60.5 | 64.5 | 65.5 | 65.5 |
| Al | — | — | — | 7.0 | 3.0 | 1.0 | — |
| B | 7.0 | 3.0 | 1.0 | — | — | — | — |

[a]The binder was composed of 6% by weight acrylic and 94% by weight ethyl acrylate and had an intrinsic viscocity of about 0.5 dl/g as about a 0.5 gram/deciliter solution in ethyl acetate at 25°C. The ratio of polymer to plasticizer (TVOPA) was 15/85.

[b]About 1.7 weight percent of Unox 221 was also added as a cross-linking agent.

EXAMPLE 8

The compositions of Examples 1–7 and the other propellant compositions of this invention may be prepared by employing the following general scheme. However, it should be noted that other conventional methods may also be used. The binder material and the aluminum or boron are premixed under vacuum conditions and at an elevated temperature of about 50°C. The oxidizing agent is added in increments with mixing under vacuum and elevated temperatures to this binder — aluminum/boron premix. After all the oxidizing agent is added, the mixture is stirred further for about 2 hours. At this point the cross-linking agent is added and the mixture is stirred for about five to ten minutes under vacuum. This total mixture is then cast and allowed to cure in an oven for about 24 hours or more at a temperature of about 50°–65°C.

The preparation of the binder material follows the following general scheme, however, other procedures known to those skilled in the art may also be employed.

About ⅔ of the ethyl acetate to be used as solvent is added to a flask and mixed with all of the ethyl acrylate monomer. Thereafter all of the acrylic acid monomer is added with a portion of the remaining ethyl acetate solvent. Finally the polymerization catalyst, benzoyl peroxide, is added with the remaining ethyl acetate solvent. The mixture is stirred and heated to about 185°F. A reflux condenser is used to prevent vaporization of the material in the flask. Refluxing is continued for 24 hours. The polymer is recovered by vacuum stripping the ethyl acetate.

Obviously, numerous modifications and variations of the present invention are possible in light of the above teachings. It is therefore to be understood that within the scope of the appended claims the invention may be practiced otherwise then as specifically described herein.

What is claimed as new and desired to be secured by Letters Patent of the United States is:

1. A solid rocket propellant comprising (1) about 25–55 weight percent of a binder which comprises (a) about 2–25 weight percent of a polymer which comprises about one to about 20 weight percent acrylic acid with the remainder comprising a lower alkyl acrylate and (b) about 75–98 weight percent of an energetic difluoroamino group containing plasticizer, selected from the group consisting of 1,2,3-tris[$\alpha,\beta$-bis (difluoroamino) ethoxy] propane, hexakis (difluoroamino) propylether, 1,2-di[2,2,3-tris(difluoroamino) propoxy]-1,2-bis(difluoroamino)ethane, 1,2,4,5-tetrakis(difluoroamino)amyl methacrylate and mixtures thereof, (2) about 0–15 weight percent of a fuel selected from the group consisting of aluminum, boron and mixtures thereof, (3) about 45–75 weight percent of an oxidizer, and (4) about ½–5 weight percent curing agent, provided that the amount of oxidizer present be sufficient to provide for complete oxidation of said binder and said fuel.

2. The composition of claim 1 wherein said copolymer portion of said binder contains about 6–8 weight percent of acrylic acid with the remainder comprising a lower alkyl acrylate.

3. The composition of claim 2 wherein said lower alkyl acrylate is selected from the group consisting of methyl acrylate, ethyl acrylate and butyl acrylate.

4. The composition of claim 2 wherein said lower alkyl acrylate is ethyl acrylate.

5. The composition of claim 1 wherein said copolymer has an intrinsic viscosity of about 0.2–1.1 dl/g as a 0.5 gram per deciliter solution in ethyl acetate at about 25°C.

6. The composition of claim 1 wherein said copolymer has an intrinsic viscosity of about 0.4 – 0.8 dl/g as about a 0.5 gram per deciliter solution in ethyl acetate at about 25°C.

7. The composition of claim 1 wherein said fuel is aluminum.

8. The composition of claim 1 wherein said fuel constitutes about 1–15 weight percent of said rocket propellant.

9. The composition of claim 2 wherein said fuel is aluminum.

10. The composition of claim 1 wherein said oxidizer is selected from the group consisting of ammonium perchlorate, nitronium perchlorate, hydroxylammonium perchlorate and its derivatives, hydroxylammonium nitrate and its derivatives, potassium perchlorate, ammonium nitrate and potassium nitrate.

11. The composition of claim 1 wherein said oxidizer is ammonium perchlorate.

12. The composition of claim 1 wherein said curing agent is selected from the group consisting of difunctional epoxides, and trifunctional epoxides.

13. The composition of claim 1 wherein said curing agent is selected from the group consisting of

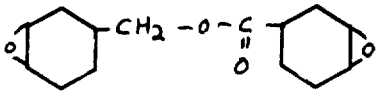

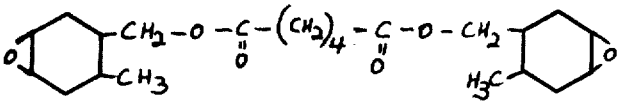

bisphenol A - epichlorohydrin epoxides, tolylene diisocyanate, hexamethylene diisocyanate and mixtures thereof.

14. A method of reducing the combustion instability of a solid rocket propellant comprising (1) about 2–25 weight percent of a binder which comprises (a) 2–25 weight percent of a polymer which comprises about one to about 20 weight percent acrylic acid and with the remainder comprising a lower alkyl acrylate and (b) about 75–98 weight percent of an energetic difluoroamino group containing plasticizer selected from the group consisting of 1,2,3-tris[$\alpha,\beta$-bis (difluoroamino) ethoxy] propane, hexakis (difluoroamino) propylether, 1,2-di[2,2,3-tris (difluoroamino) propoxy]-1,2-bis(difluoroamino)ethane, 1,2,4,5-tetrakis (difluoroamino)amyl methacrylate and mixtures thereof, (2) about 45–75 weight percent of an oxidizer, and (3) about ½–5 weight percent curing agent comprising adding to said propellant 1–15 weight percent of a material selected from the group consisting of aluminum, boron and mixtures thereof provided the amount of oxidizer present is sufficient to provide for complete oxidation of said binder and said aluminum, boron and mixtures thereof.

* * * * *